US010722031B2

(12) United States Patent
Sobolewski et al.

(10) Patent No.: US 10,722,031 B2
(45) Date of Patent: Jul. 28, 2020

(54) WALL OF A BASIC FURNITURE STRUCTURE, METHOD FOR PRODUCING SUCH A WALL, AND BASIC FURNITURE STRUCTURE OR PIECE OF FURNITURE HAVING SUCH A WALL

(71) Applicant: AMBIGENCE GMBH & CO. KG, Herford (DE)

(72) Inventors: Uwe Sobolewski, Bünde (DE); Michael Tasche, Bielefeld (DE); Stefan Andschus, Lübbecke (DE); Michael Schubert, Coburg (DE)

(73) Assignee: AMBIGENCE GmbH & CO. KG, Herford (DE)

( * ) Notice: Subject to any disclaimer, the term of this patent is extended or adjusted under 35 U.S.C. 154(b) by 0 days.

(21) Appl. No.: 16/489,163

(22) PCT Filed: Feb. 23, 2018

(86) PCT No.: PCT/EP2018/054537
§ 371 (c)(1),
(2) Date: Aug. 27, 2019

(87) PCT Pub. No.: WO2018/158158
PCT Pub. Date: Sep. 7, 2018

(65) Prior Publication Data

US 2020/0008578 A1 Jan. 9, 2020

(30) Foreign Application Priority Data

Feb. 28, 2017 (DE) ..... 10 2017 104 170

(51) Int. Cl.
*A47B 96/20* (2006.01)
*A47B 96/04* (2006.01)
*E05D 3/06* (2006.01)

(52) U.S. Cl.
CPC ..... *A47B 96/205* (2013.01); *A47B 96/04* (2013.01); *E05D 3/06* (2013.01); *E05Y 2900/20* (2013.01)

(58) Field of Classification Search
CPC . A47B 96/205; A47B 96/20; A47B 2096/207; A47B 95/00; E05D 15/40; E05D 15/00; E06B 3/5045
See application file for complete search history.

(56) References Cited

U.S. PATENT DOCUMENTS 4,365,454 A * 12/1982 Davis ..... A47B 96/205 446/109
5,119,593 A 6/1992 Bae
(Continued)

FOREIGN PATENT DOCUMENTS

DE 1559963 A1 12/1969
DE 202013003189 U1 7/2014
(Continued)

OTHER PUBLICATIONS

International Search Report dated Apr. 17, 2018 in related/corresponding International Application No. PCT/EP2018/054537.
(Continued)

*Primary Examiner* — Daniel J Rohrhoff
(74) *Attorney, Agent, or Firm* — Patent Portfolio Builders PLLC

(57) ABSTRACT

A wall for a basic furniture structure, having a panel-like core, which is arranged between two laterally positioned cover layers. The core has a recess extending at least along part of an end side of the wall and serves for accommodating a fitting, which guides a movable furniture part. The core has two core halves, which are located one upon the other by
(Continued)

way of their side surfaces located opposite the respective cover layer and have recesses which supplement one another to form the recess.

22 Claims, 12 Drawing Sheets

(56) References Cited

U.S. PATENT DOCUMENTS

| | | | | |
|---|---|---|---|---|
| 2015/0272346 | A1* | 10/2015 | Aumiller | A47F 3/0426 312/204 |
| 2019/0166992 | A1* | 6/2019 | Held | E05D 13/00 |
| 2019/0316396 | A1* | 10/2019 | Kruedener | F16B 12/50 |
| 2019/0380494 | A1* | 12/2019 | Sobolewski | F16B 5/0012 |
| 2019/0383079 | A1* | 12/2019 | Sobolewski | E05D 15/463 |
| 2020/0008579 | A1* | 1/2020 | Sobolewski | A47B 96/205 |

FOREIGN PATENT DOCUMENTS

| | | | | |
|---|---|---|---|---|
| DE | 102016125436 | A1 * | 6/2018 | E05F 1/1041 |
| DE | 202018102083 | U1 * | 7/2019 | E05D 3/16 |
| WO | 2010115429 | A1 | 10/2010 | |
| WO | WO-2019134938 | A1 * | 7/2019 | A47B 96/205 |

OTHER PUBLICATIONS

Written Opinion dated Apr. 17, 2018 in related/corresponding International Application No. PCT/EP2018/054537.

* cited by examiner

WALL OF A BASIC FURNITURE STRUCTURE, METHOD FOR PRODUCING SUCH A WALL, AND BASIC FURNITURE STRUCTURE OR PIECE OF FURNITURE HAVING SUCH A WALL

BACKGROUND AND SUMMARY OF THE INVENTION

Exemplary embodiments of the invention relate to a wall, in particular a side wall, of a furniture body, having a panel-shaped core arranged between two laterally positioned cover layers, wherein the core has a recess extending at least along a section of an end face of the wall and serves to receive a fitting that guides a movable furniture part. The invention also relates to a method for manufacturing such a wall and a furniture body or a piece of furniture having such a wall.

Furniture, in particular kitchen furniture such as base units or wall units, generally have a furniture body open towards the front, on which movable furniture parts guided by fittings are mounted. The movably guided furniture parts can be drawers with a drawer front or doors or flaps, which can be used individually or in different combinations in a furniture body. The present application relates in particular to the use of doors and flaps as movable furniture components. For the purposes of this application, doors and flaps are distinguished by the orientation of their pivot axis, which is vertical for doors and horizontal for flaps.

The doors and flaps can be integral or consist of several individual parts, such as a folding flap in which different parts of the flap move relative to each other in the movement sequence.

Door hinges are usually used to guide doors, which are arranged on the side of the pivot axis between the furniture body and the door. A comparable arrangement of hinges can also be used for flaps. These hinges are then arranged along an upper side edge of the flap. However, it is often desired to open the flaps in a combined pivoting and sliding movement in order, for example in the case of a wall cabinet, to obtain the greatest possible access to the interior of the cabinet without having to pivot the flap into a horizontal position in which it is difficult or impossible for the user to reach it to close. For this reason, special flap fittings have become established that are not arranged along the pivot axis between the furniture body and the flap, but on the side edges (usually both) between the flap and the side wall of the furniture body.

Such door hinges or flap fittings are well known for mounting on the inside of the side wall or side walls of the furniture body. However, the fittings inevitably protrude into the interior of the furniture body, which on the one hand reduces the usable storage space within the furniture body and on the other hand also impairs the structuring of the interior of the furniture body. The mounted fittings also make it difficult to clean the interior, especially the inside of the side wall of the furniture body. Last but not least, a side wall on which no fittings are mounted is desirable for optical reasons.

For the assembly of door hinges it is known to mill a pocket into the front side of a side wall in which the door hinge can be inserted from the front. In this way, the inside of the side wall remains free. A hinge suitable for use in such a milled pocket is known from the publication DE 1 559 963 A, for example.

However, this procedure is only suitable for door hinges with a very low installation depth. This is due to the limited milling depth with which such a pocket can be economically milled from the end face into the side wall during the manufacturing process. The installation thickness of the door hinge inserted in such a milled pocket is also very limited, as the side walls in the furniture area only have a wall thickness of about 16-20 mm (millimeters). During the milling process, a certain minimum wall thickness must remain on the side of the milled pockets, since a wall that is too thin would tear or break during the milling process or would be deformed in such a way that it no longer has a perfect surface.

Even the use of larger and more complex door hinges is not possible in this way. Flap hinges usually have a large installation depth of more than 10 or 15 cm (centimeters), which cannot be achieved by milling from the end face.

Publication DE 20 2013 003 189 U1 discloses a side wall for a furniture body that is made of different parts in sections. In particular, a rear part facing away from the furniture front is conventionally designed, e.g., by a coated wooden element. A front part of the side wall is formed by a housing, not described in detail in the above text, which has a front opening into which a fitting can be inserted. The housing is connected to the conventional part of the side wall, e.g., via dowels or screws. Since the housing can be provided with thinner housing walls than is possible by milling and also allows larger installation depths, this housing can also be used to accommodate larger door hinges or a flap fitting. However, the surface appearance and haptics of the housing will generally not correspond exactly to those of the conventional part of the side wall, so that a uniform surface of the side wall cannot be achieved. In addition, a transition between the two housing parts will be visible and optionally also perceptible.

Exemplary embodiment of the present invention are directed to a wall and a method for producing a wall for a furniture body and a piece of furniture or furniture body with a wall, wherein the wall is also able to accommodate larger fittings, in particular flap fittings, but also door hinges with a larger installation depth, and the wall is characterized by a uniform surface quality on both its outside and inside.

A wall of the type mentioned at the beginning and according to the invention is characterized in that the core has two core halves that are located one upon the other by way of their side surfaces located opposite the respective cover layer and have recesses that supplement one another to form the recess.

A method according to the invention for the production of such a wall for a furniture body comprises the following steps: providing panel-shaped core halves, into each of which a recess is introduced or which extends along at least one section of an end face of the respective core half. A lateral cover layer is applied to each of the core halves before or after the recess has been made. The two core halves are joined together to form a core, wherein the side surfaces of the core halves opposite the respective cover layer rest on top of each other.

The wall according to the invention is thus a composite element consisting of a core and cover layers, wherein the recess in the core required to accommodate the fitting is thus, in accordance with the invention, already made during the production of the wall before the cover layers are applied. Thus, there are no restrictions on the size of the recess, as is the case when the recess for the fitting is inserted in a completely prefabricated wall. This means that large fittings can also be used which, for example, take up the entire or almost the entire width of the wall. At the same time, the wall has a preferably integral, continuous cover layer on both sides.

The respective recess can, for example, be milled out of the core halves, preferably from one of the side surfaces of the core. Alternatively, the core halves, which can, for example, be made of a fiber material, can also be produced directly with the recesses in a primary forming process.

In an advantageous embodiment of the method, a fitting is inserted into the recess before at least one of the two lateral cover layers is applied to the core. Preferably, the fitting is also connected to the core before the cover layer is applied or the cover layers are applied. For example, the fitting can be screwed, clamped, and/or glued to the core before at least one of the two lateral cover layers is applied to the core. The result is a wall for a furniture body with a firmly integrated fitting, which simplifies the production of the furniture body.

In an advantageous embodiment of the method, a fitting is inserted into the recesses before the two core halves are joined together. The fitting can, for example, engage in the core halves with staples or claws to fasten it. The two core halves can be glued together and/or connected by means of further connecting means. The result is a wall for a furniture body with a firmly integrated fitting, which simplifies the production of the furniture body.

In an advantageous embodiment of the wall, the side surfaces are aligned parallel to the cover layers. Preferably at least one of the recesses penetrates the associated core half at least partially up to the respective cover layer. At most, the recess can be as wide as the two halves of the core are together. This provides the fitting with an installation width corresponding to the maximum thickness of the core. Fittings with a width of up to approx. 20 mm can also be used for furniture walls of the usual thickness. However, the recess can also be narrower than the distance between the two cover layers. The preferred wall thickness is between 15 mm and 20 mm.

The fitting is preferably connected to the core halves and/or at least one of the cover layers so that forces acting on it can be transferred as safely as possible to the wall. For example, at least one of the core halves may have a reduced thickness for connection along an edge of the respective recess in such a way that a shoulder surface is formed towards the recess, on which shoulder surface the fitting rests with at least one tab projecting beyond its edge. Preferably, the at least one tab is used to display at least one staple, which is pressed into the material of at least one half of the core in the area of the shoulder surface. This is a particularly simple way of connecting the fitting to the core during the wall manufacturing process. Alternatively, or additionally, the fitting may be bonded to the core and/or at least one of the two cover layers.

In another alternative connection method, which is also particularly simple in the wall manufacturing process, connecting elements are formed from the core halves adjacent to the recess, which engage in the fitting. The fitting then has side plates with recesses, with the recesses forming mating contours into which the connecting elements engage. Core and fitting are therefore laid one inside the other like puzzle pieces and are connected with each other in a form-fit manner. The role of connecting elements and recesses as contours and mating contours can of course also be reversed, so that the recess is formed in the core and the engaging connecting element in the fitting.

In another advantageous embodiment of the wall, the fitting can have two parallel side plates whose spacing corresponds to the thickness of the core. It is also possible for the fitting to have an adjustment unit in order to vary the distance between the side plates and thus be able to compensate for the thickness of the core.

In another advantageous embodiment of the wall, the fitting features a lever mechanism that guides the movable part of the furniture. When the movable part of the furniture is closed, the lever mechanism is preferably located between the cover layers. The fitting is then so completely integrated into the furniture body that—unavoidably—only the lever mechanism is visible, and even this only when the movable part of the furniture is open.

In another advantageous embodiment of the wall, at least one edge band is applied to at least one of the end faces of both core halves or the core. In the area of the front end face of the core, the edge band is preferably applied only when the fitting has been integrated or inserted, wherein the edge band is arranged at least in sections on the fitting. In this way, for example, the edges of the side plates of the fitting can be covered.

A piece of furniture or furniture body according to the invention has at least one such wall manufactured in accordance with a method described above. This gives rise to the advantages described in connection with the wall or the method.

In an advantageous embodiment of the piece of furniture or furniture body, at least one wall is a side wall and/or a partition wall. The fitting can be a flap fitting or a door fitting.

In the context of the application, the wall according to the invention may be arranged on either side of the furniture body, irrespective of its orientation. In particular, the wall can be arranged in any orientation within the furniture body, especially vertically, horizontally or diagonally, for example diagonally in the furniture body.

BRIEF DESCRIPTION OF THE DRAWING FIGURES

The invention will be explained in more detail below by reference to embodiment examples shown in the drawings, wherein:

FIG. 1 shows a first embodiment example of a piece of furniture with a wall according to the application;

FIGS. 2*a*, 2*b* show a second embodiment example of a piece of furniture with a wall according to the application in two different opening positions of a flap;

FIGS. 3*a*, 3*b* show a third embodiment example of a piece of furniture with a wall in two different opening positions of a flap in accordance with the application;

FIG. 4 shows a fourth embodiment example of a piece of furniture with a wall according to the application;

FIG. 5*a* shows a first embodiment example of a wall designed as a composite element in accordance with the application in a schematic exploded view;

FIG. 5*b* shows a sectional drawing of a detail of the first embodiment example of the wall in accordance with the application pursuant to FIG. 6*a* in an assembled state;

DETAILED DESCRIPTION

Figure 1:
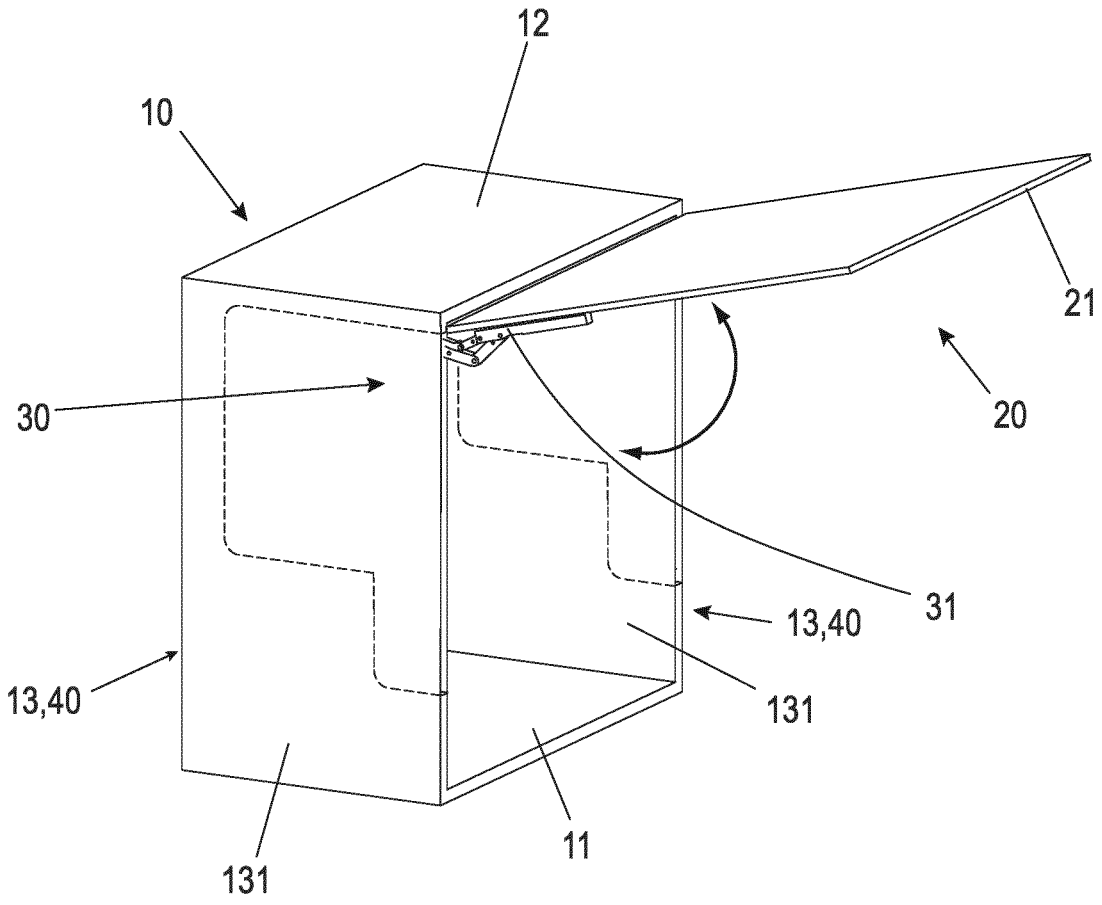

FIG. 1 shows in an isometric representation a wall unit of a kitchen, for example, as the first embodiment example of a piece of furniture with a (side) wall according to the application.

The wall unit comprises a furniture body 10 with bottom panel 11 and top panel 12 as well as two side walls 13. A rear wall is preferred for reasons of stability but is not shown in this embodiment example.

The furniture body 10 is open to the front to allow access to the interior of the cupboard. A flap arrangement 20 with an integral flap 21 is provided to close the opening of the furniture body 10. The integral flap 21 is pivoted along its upper horizontal side edge. For this purpose, fittings 30 are provided that are connected to the integral flap 21 with a lever mechanism 31 in the upper part of the flap 21.

The fittings 30 (with the exception of the lever mechanism 31 extended in the opening position shown) are arranged within the respective side wall 13. When flap 21 is closed, the lever mechanism 31 may be fully retracted into the side wall 13, optionally except for the mounting elements for connecting it to flap 21. The area within the side wall 13 in which the fitting 30 is located is indicated by a dashed line in FIG. 1.

The side wall 13 is characterized by side surfaces 131, which are ideally integral and can have the same surface texture throughout the entire surface. The surface of the integral side surfaces 131 can create design effects through different patterns, surface textures or different colors. This preferably applies both to an outer side surface 131 and to an inner side surface 131 facing the interior of the furniture body 10. The side walls 13 also have an end face 132, which has an opening 133 in the area of the fitting 30, into which the lever mechanism 31 of the fitting 30 dips or from which the lever mechanism 31 extends. When the damper arrangement 20 is closed, the lever mechanism 31 is completely immersed in the opening 133, except for any fastening means with which it is connected to the integral flap 21.

According to the application, the side walls are 13 composite elements, which are explained in more detail in connection with the FIG. 5*ff.*

Figure 2A:
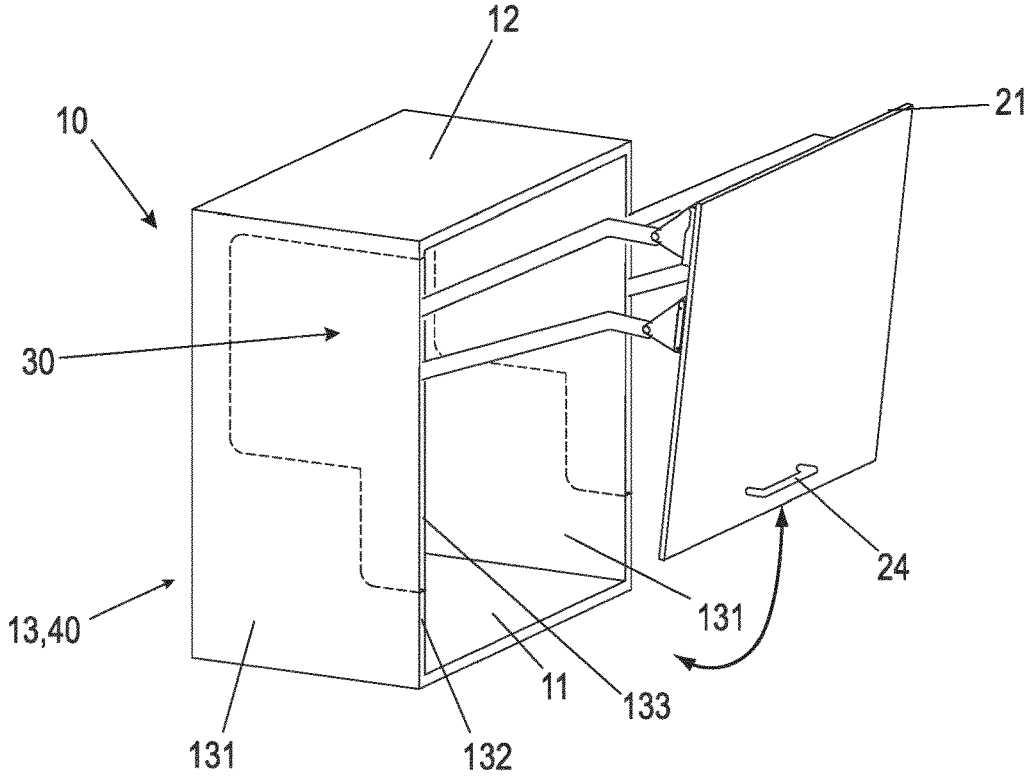
Figure 2B:
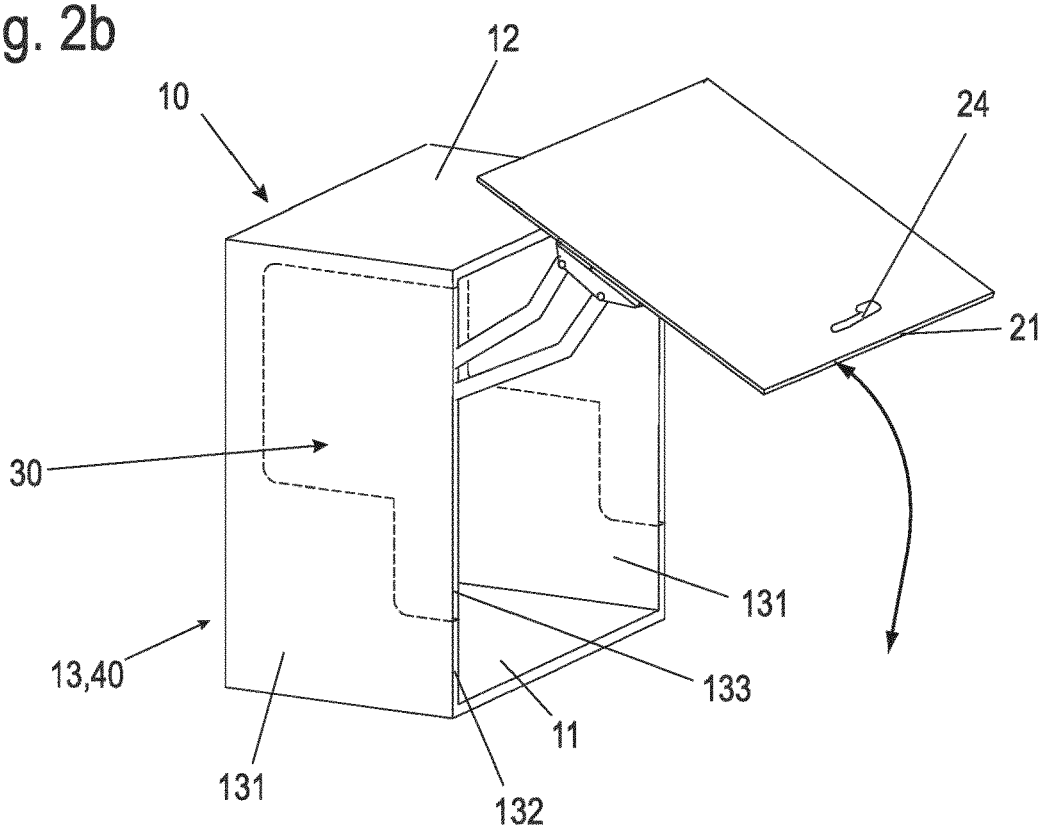

FIGS. 2*a* and 2*b* show another wall unit as an example of a piece of furniture with a side wall in accordance with the application, each in an isometric view.

As in the example in FIG. 1, an integral flap 21 is provided as flap arrangement 20 to close a furniture body 10 to the front. The two FIGS. 2*a* and 2*b* differ in the opening state of the flap arrangement 20. FIG. 2*a* shows a partially opened state of the flap arrangement 20, wherein FIG. 2*b* shows the maximum opening state of the flap arrangement 20. In contrast to the embodiment example in FIG. 1, a lifting and pivoting fitting is provided, which enables a combined pivoting and displacing movement of the integral flap 21. In the fully open position shown in FIG. 2*b*, at least part of flap 21 is positioned above top panel 12 of furniture body 10. In this way, good access to the interior of furniture body 10 is achieved without the lower edge of flap 21, in the area of which a handle 24 is mounted, pivoting to the height of the upper floor 12. In this way, even if the wall unit is mounted high in the room, the flap 21 is easily accessible in the open position so that it can be closed again.

As in the embodiment example of FIG. 1, the side walls 13 are designed as composite elements 40, which accommodate the fitting 30.

Figure 3A:
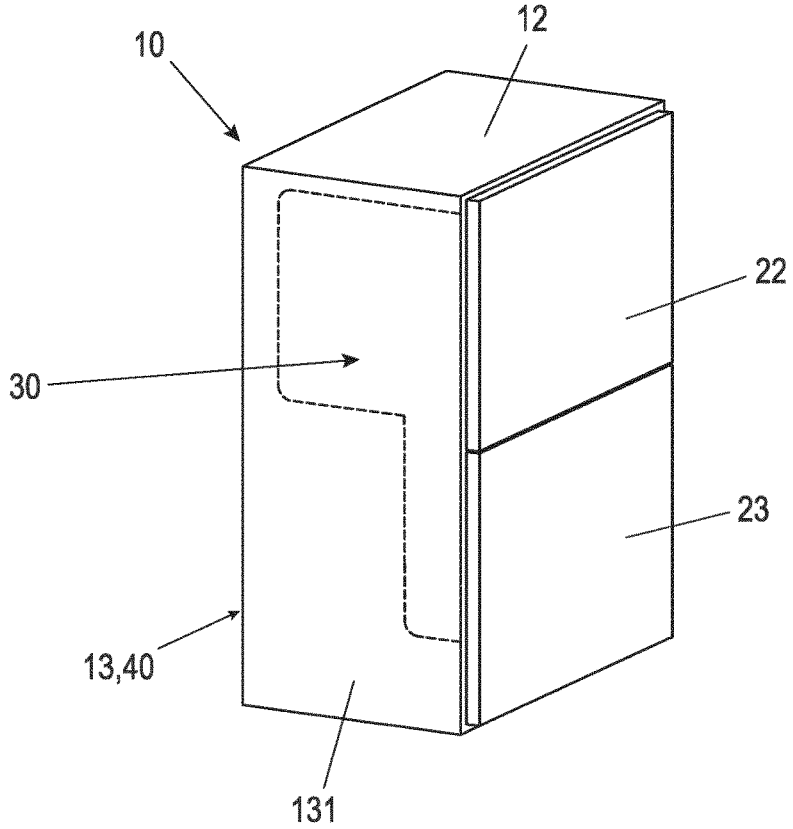
Figure 3B:
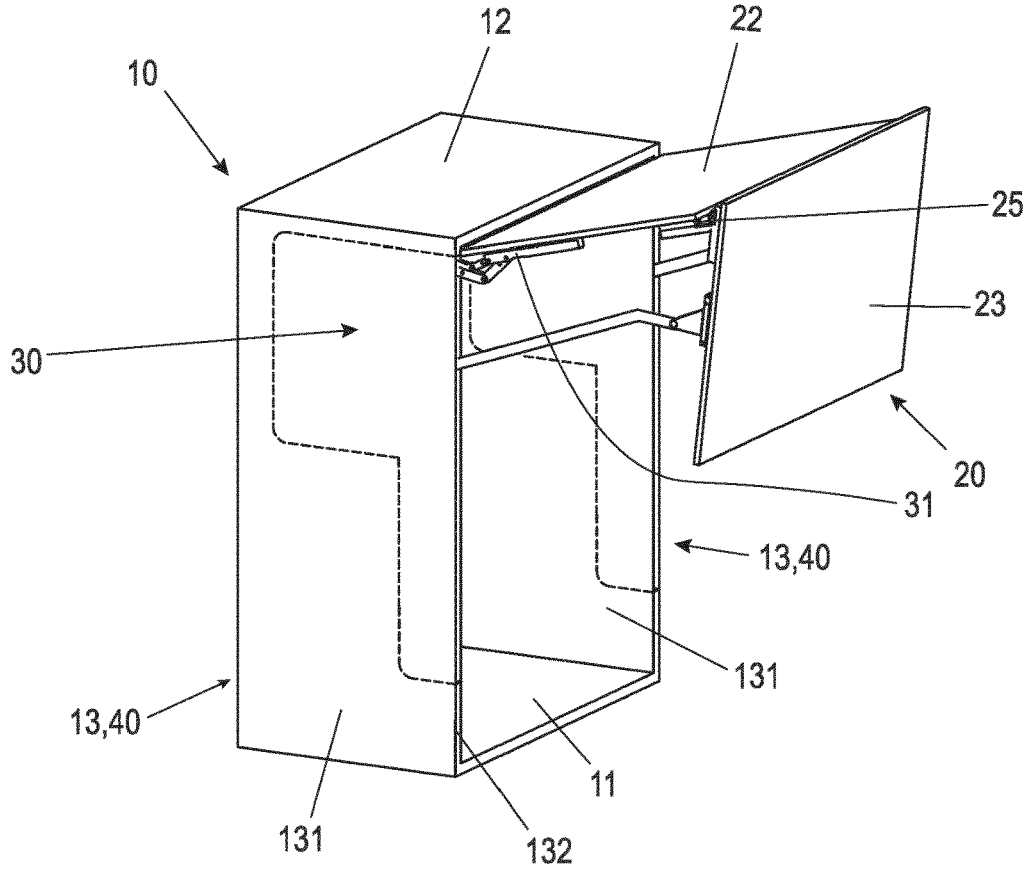

FIGS. 3*a* and 3*b* show another embodiment example of a wall unit with furniture body 10 and flap arrangement 20. FIG. 3*a* shows the flap arrangement 20 in a closed position and FIG. 3*b* in an open position.

This piece of furniture has a two-part flap arrangement 20 with an upper flap part 22 and a lower flap part 23. Again, the side walls 13 are designed as composite elements that accommodate a fitting 30. This is coupled with lever mechanisms 31 both with the upper flap part 22 and with the lower flap part 23. In addition, additional hinges 25 are provided, which pivotably connect the upper and lower flap parts 22, 23 with each other along their connecting line. Depending on the design of the flap fitting, the hinges can also be omitted.

As in the embodiment example for FIGS. 2*a*, 2*b*, good access to the interior of furniture body 10 is also achieved here without the flap arrangement 20 pivoting too far upwards in the open state for the user to reach.

Figure 4:
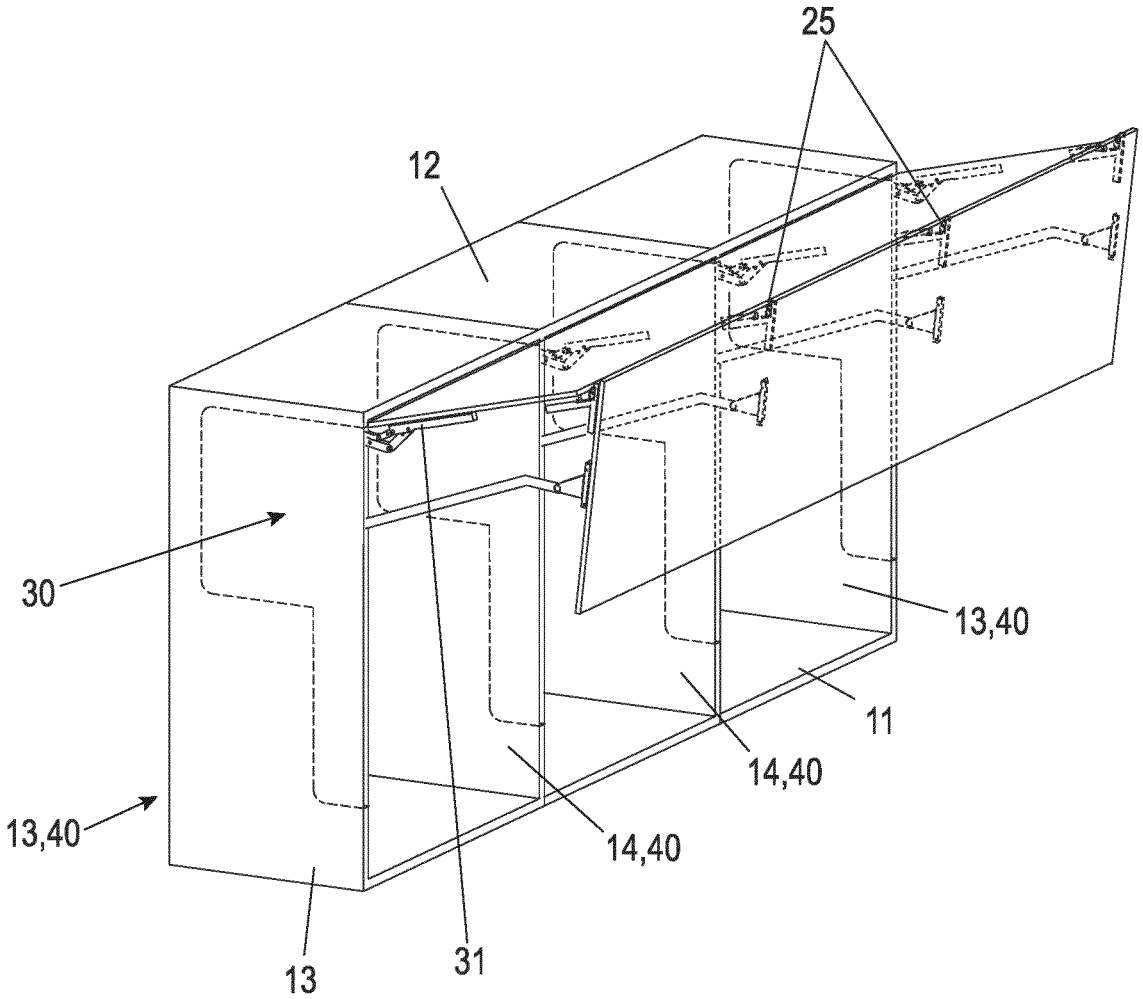

FIG. 4 shows another wall unit with furniture body 10 and flap arrangement 20, in which fittings 30 for guiding the flap arrangement 20 are arranged in composite elements 40. In the example shown, the furniture body 10 has an interior divided by vertical partition walls 14. Two partition walls 14 are provided in this case, which divide the interior into three sections. In this embodiment, each partition wall 14 is designed as a composite element 40. However, the arrangement shown can also be realized with only one partition wall or more than the illustrated two partition walls 14.

The flap arrangement 20 is comparable with the embodiment example of FIGS. 3*a* and 3*b* in two parts with an upper flap part 22 and a lower flap part 23. The flap arrangement 20 extends in its width, and also the upper and lower flap parts 22, 23, over the entire furniture body 10. In order to be able to guide the flap arrangement 20 smoothly, fittings 30 are also present in the intermediate walls 14. Both the side walls 13 and the partition walls 14 are designed as composite elements 40 in accordance with the application.

In all the embodiment examples shown, the composite elements are characterized by continuous side surfaces with a uniform surface look and feel across the entire surface. In particular, no transition in the area of the edge of the fitting 30 is discernible in the surface.

Figure 5A:
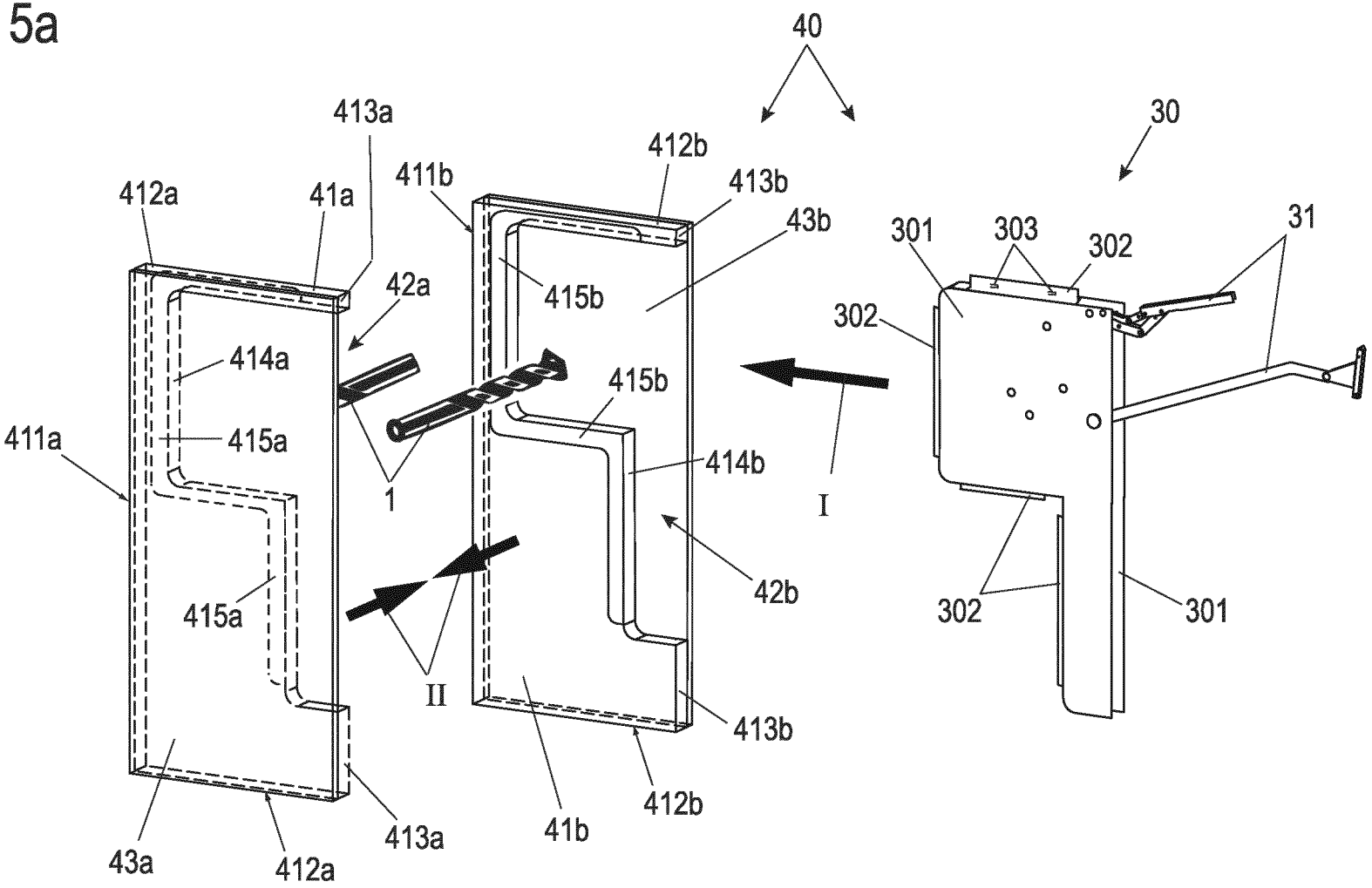

A first embodiment example of a composite element 40 with which this is achieved is shown in FIG. 5*a* in an isometric exploded view. The composite element 40 shown can be used, for example, as a side wall 13 in the embodiment examples of FIGS. 1-4 and also as a partition wall 14 in the embodiment example of FIG. 4.

The composite element 40 comprises two basic elements, each of which has a panel-shaped core half 41*a*, 41*b* and a recess 42*a* and 42*b*, respectively, which are constructed in mirror image. After later joining, the two core halves 41*a* and 41*b* together form a core 41 of the composite element. The recesses 42*a* and 42*b* can also be designed differently. The shape of the recesses 42*a* or 42*b* depends on the fitting to be used and its external geometry.

The core halves 41*a* and 41*b*, for example, are made of chipboard or medium density or high density fiberboard (MDF—Medium Density Fiberboard or HDF—High Density Fiberboard). The core halves 41*a*, 41*b* each have a rectangular offset of the size which the side or partition wall will later have in the furniture body to be manufactured (cf.

e.g., side wall 13 of furniture body 10 according to the embodiment examples of FIGS. 1-4). Three end faces of each core half 41*a*, 41*b*, one respective left end face 411*a*, 411*b* in FIG. 5*a* and a lower or upper end face 412*a*, 412*b* run straight according to the rectangular offset.

Even if in the example shown the core halves 41*a* and 41*b* are of equal strength, the term 'core halves' within the terms of the application also includes core halves 41*a* and 41*b* of different thicknesses.

A large flat recess 42*a*, 42*b* is introduced in each case into the core halves 41*a*, 41*b*, which is open towards a fourth end face 413*a*, 413*b*. Only in the upper and/or lower area of the core halves 41*a*, 41*b* remains in each case a narrow section of the end face 413*a*, 413*b* on this side. The recesses 42*a*, 42*b* can be mirror symmetrical. In the area in between, the edge of the recess 42*a*, 42*b* now forms an end face 414*a*, 414*b* which follows the contour of the recess 42*a*, 42*b* and is offset inwards.

The contour of the recesses 42*a*, 42*b* corresponds to the outer contour of a fitting 30 to be inserted, here an approximately L-shaped contour. The recesses 42*a*, 42*b* can, for example, each be milled into the core halves 41*a*, 41*b* using the symbolic milling tools 1 shown. Other cutting techniques such as drilling in conjunction with (dip) saw cuts can also be used to create recesses 42*a*, 42*b*. As an alternative to the machining or ablating process for producing the recess 42*a*, 42*b*, a master molding process (e.g., in accordance with the DIN 8580 standard) can also be used for producing the core halves 41*a*, 41*b*, by means of which the respective core half 41*a*, 41*b* at least partially already receives its finished shape including the recess 42*a*, 42*b*. With an appropriate forming tool, the recess can also be pressed during the manufacture of the panel. The milling can be carried out through the entire thickness of the respective core half 41*a*, 41*b*. Depending on the thickness of the fitting 30 to be used, a thin wall of the material of the core halves 41*a* or 41*b* can also be left in the area of the recess 42*a* or 42*b*.

It should be noted that machining can be carried out from one of the side surfaces of the respective core half 41*a*, 41*b*. Machining only from the end face 413*a* or 413*b* is not required for core halves 41*a*, 41*b*. This means that the recess can easily assume any depth (as seen from the original end faces 413*a*, 413*b*) and is also suitable for accommodating fittings 30 with a large installation depth. In addition, shapes such as undercuts can be created which are not possible when machining the face of a panel. When assembled, the core halves 41*a* and 41*b* form a core 41, in which the recesses 42*a* and 42*b* complement each other to form a recess 42, which accommodates the fitting 30.

On the core halves 41*a*, 41*b*, a cover layer 43*a* or 43*b* is applied mirror-inverted, for example laminated thereon. This can be carried out either before or after creating the recesses 42*a*, 42*b*. These cover layers 43*a*, 43*b* are preferably already provided with a decorative surface. Their thickness ranges from a few tenths of a millimeter to about 2 or 3 mm.

For assembly, for example, fitting 30 can be guided between the two core halves 41*a* and 41*b* in a first assembly step I and both core halves 41*a* and 41*b* can be closed around fitting 30 and connected to each other in a second assembly step II in the manner of a shell.

Alternatively, fitting 30 can first be inserted into one of the recesses, for example recess 42*b* of core half 41*b*. Then the second basic element, i.e., the core half 41*a* with the cover layer 43*a* and the recess 42*a*, is placed over the fitting 30 and the two core halves 41*a*, 41*b* are joined together and connected to each other.

Details on possible connections of fitting 30 with core halves 41*a, b* or the cover layers 43*a*, 43*b* are described in more detail in connection with FIGS. 5*b* and 6 to 9.

In the embodiment example shown in FIG. 5*a*, in the area of the respective end faces 414*a*, 414*b* of the core halves 41*a*, 41*b* at the edge of the recesses 42*a*, 42*b*, the respective core halves 41*a*, 41*b* are milled in sections adjacent to the end faces 414*a* or 414*b* on the sides facing away from the cover layer 43*a*, 43*b* in such a way that shoulder surfaces 415*a* and 415*b* respectively are formed, which form a shoulder opposite the remaining side surfaces of the core halves 41*a*, 41*b*.

Fitting 30 has two side plates 301 spaced apart from each other, which laterally limit fitting 30 and provide the pivot points for lever mechanism 31. Distance sleeves or bolts can be arranged between the side plates 301 to connect the side plates 301 to each other and fix them parallel to each other at a fixed distance. In alternative embodiments of the fitting 30, screw elements can also serve as spacers, which offer the possibility of varying the spacing of the side plates 301 at least slightly and thus adapting it to the thickness of the core 41.

On fitting 30, lugs 302 protrude outwards over the side plates 301 on various sides. The lugs 302, for example, can be designed as folds of correspondingly folded side plates 301.

The lugs 302 are arranged in a plane in the middle of the side plates 301. In the surface of the lugs 302 there are staples 303 arranged which protrude transversely to the lugs 302, e.g., made of the protruding material of the lugs 302.

Figure 5B:
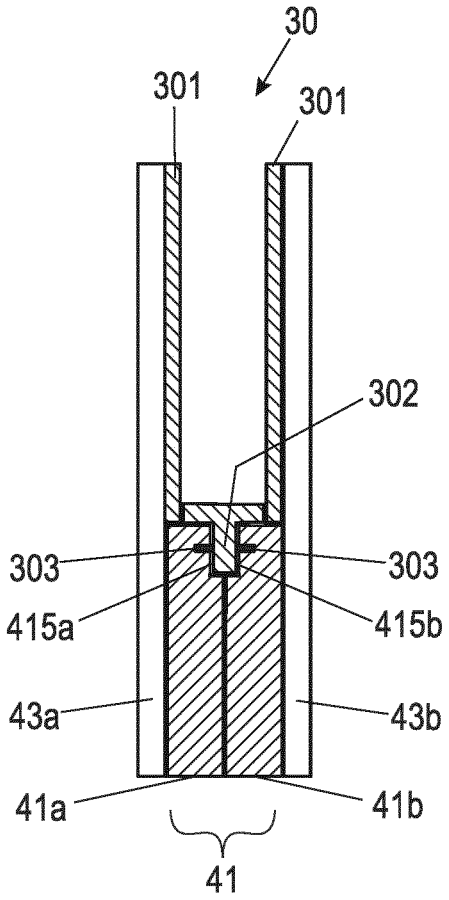

FIG. 5*b* shows a section of the composite element 40 of FIG. 5*a* in an assembled state in a schematic section in the region of the edge of the inserted fitting 30. It can be recognized that the lugs 302 are fixed in the region of the shoulder surfaces 415*a* and 415*b* respectively between the interconnected core halves 41*a*, 41*b*. By joining the core halves 41*a* and 41*b* together, the staples 303 are pressed into the material of the core halves 41*a* and 41*b* on both sides and thus fasten the fitting 30 in the composite element 40 to the core halves 41*a* and 41*b*. In addition, the core halves 41*a*, 41*b* are also connected in this way via the staples 303 and the lugs 302.

If a recess 42*a*, 42*b* does not correspond to the thickness of the corresponding core half 41*a*, 41*b*, the side plate 301 of fitting 30 can be additionally glued flat to the bottom of the recess 42*a*, 42*b* of core half 41*a*, 41*b*.

The fitting 30 and the core 41 formed from the two core halves 41*a* and 41*b* preferably have the same thickness. The thickness is preferably in a range from 12 mm to about 19 mm. The core 41 and the fitting 30 thus form a unit in which the fitting 30 is flush with the surface of the core 41 on both sides. Furthermore, the front edges of fitting 30 also run flush with the two remaining sections of the actual end faces 413*a*, 413*b* of core 41.

In a further manufacturing step not shown here, the remaining end faces 411*a*, 411*b*, 412*a*, 412*b* and 413*a*, 413*b* can be provided with a decorative layer, for example an edge band.

In the manner described, the composite element 40 is created, which in this form can directly form a side wall 13 or a partition wall 14 of a furniture body 10, as shown in FIGS. 1-4, and already has the fitting 30 for guiding a flap arrangement.

Figure 6:
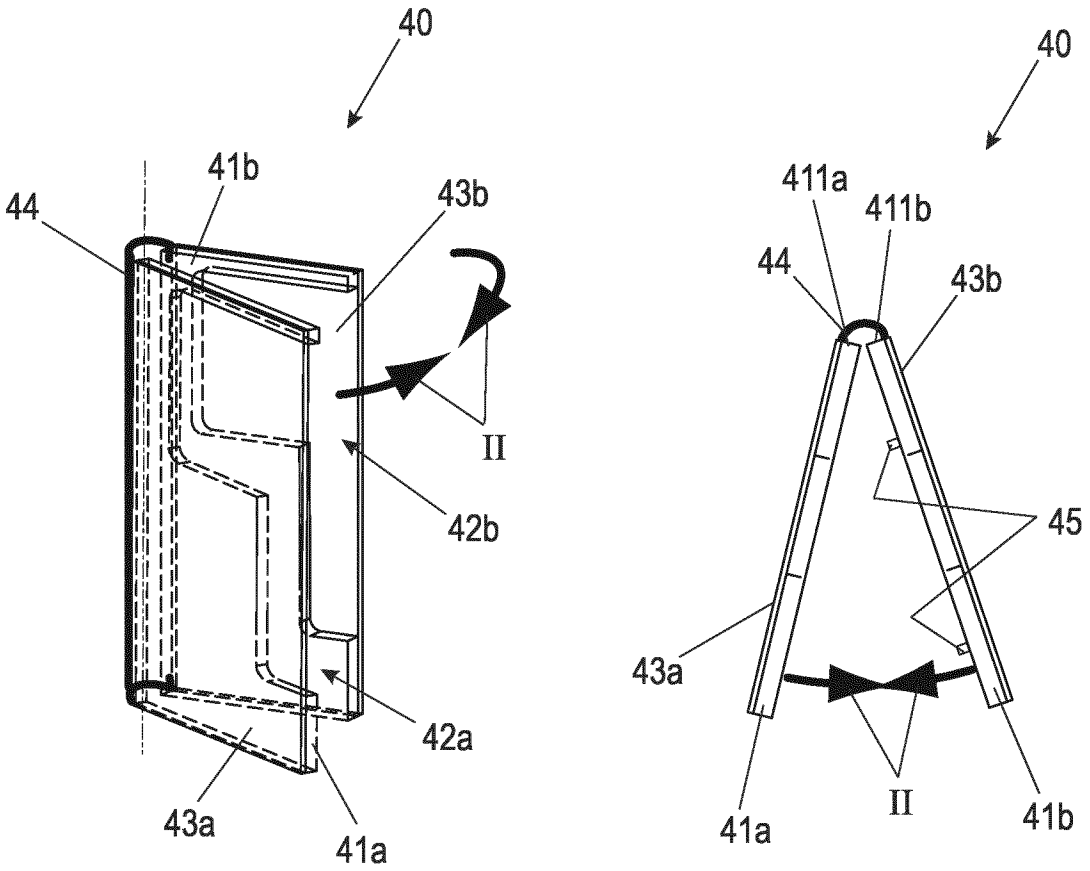
FIGS. 6, 7 show in each case a further embodiment example of a wall according to the application designed as a composite element in an intermediate stage of its production in a schematic isometric drawing (left in the figure) and a detailed sectional drawing (right in the figure)

FIG. 6 shows a further embodiment of a composite element 40 before inserting the fitting not shown here. As in the example shown in FIG. 5*a*, there are two basic elements, each comprising one core half 41*a*, 41*b* with recess 42*a* or 42*b* and cover layer 43*a* or 43*b*.

In this composite element 40, the two basic elements are connected to each other along the end faces 411*a*, 411*b* via a hinge 44, so that they can be folded together in a second assembly step II after insertion of the fitting (see assembly step I of FIG. 5*a*). In addition, pins 45 are provided, which protrude from the facing surfaces of one or both core halves 41*a*, 41*b* and which engage in corresponding holes of the respective other core halves 41*a*, 41*b*. In the example shown, a foil hinge is used as hinge 44, which may be formed from the material of the cover layers 43*a*, 43*b* or the material of the narrow surface coating.

Figure 7:
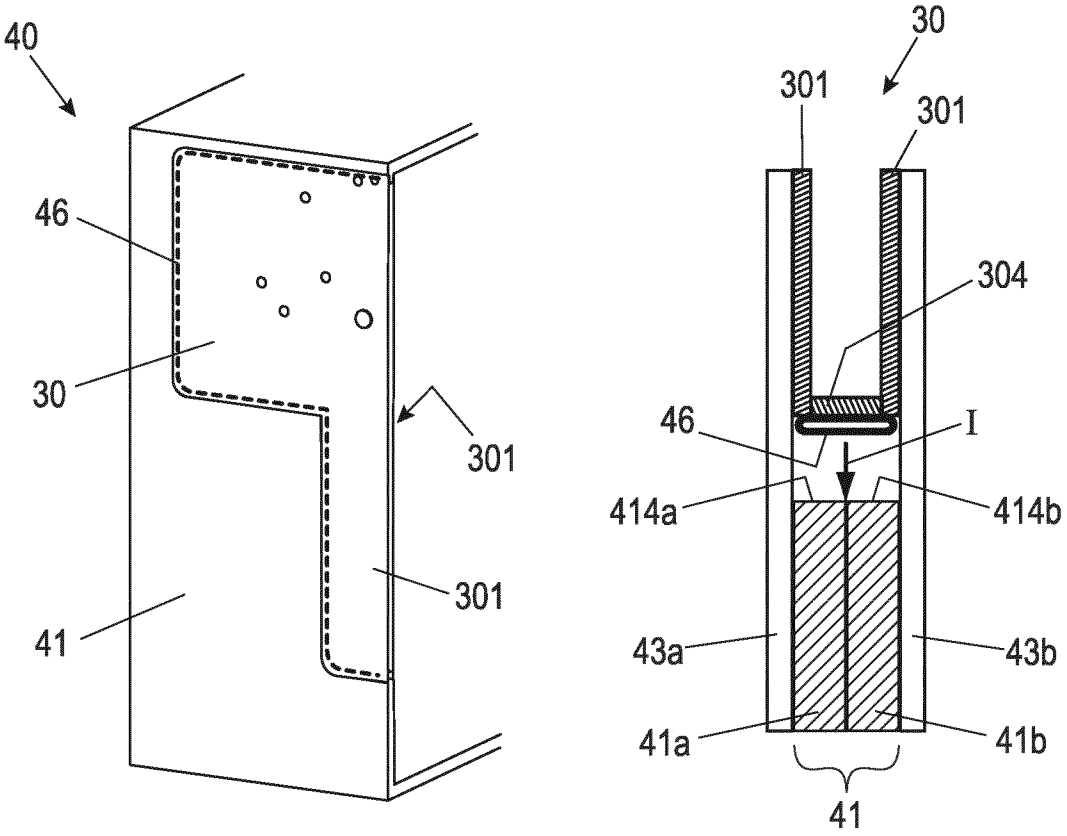
Figure 8:
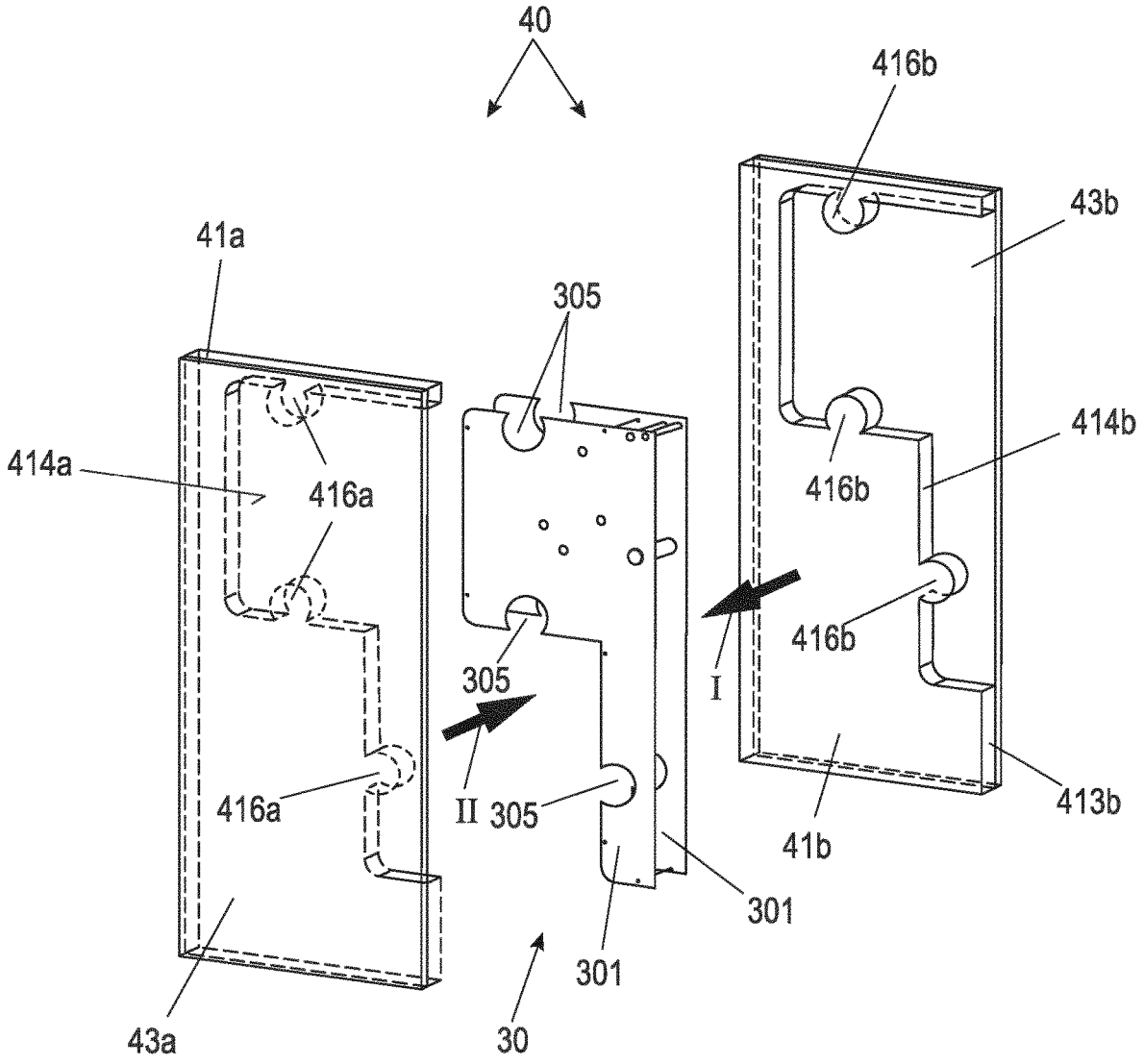
FIG. 8 shows a further embodiment example of a wall designed as a composite element in accordance with the application in a schematic exploded view.
Figure 9:
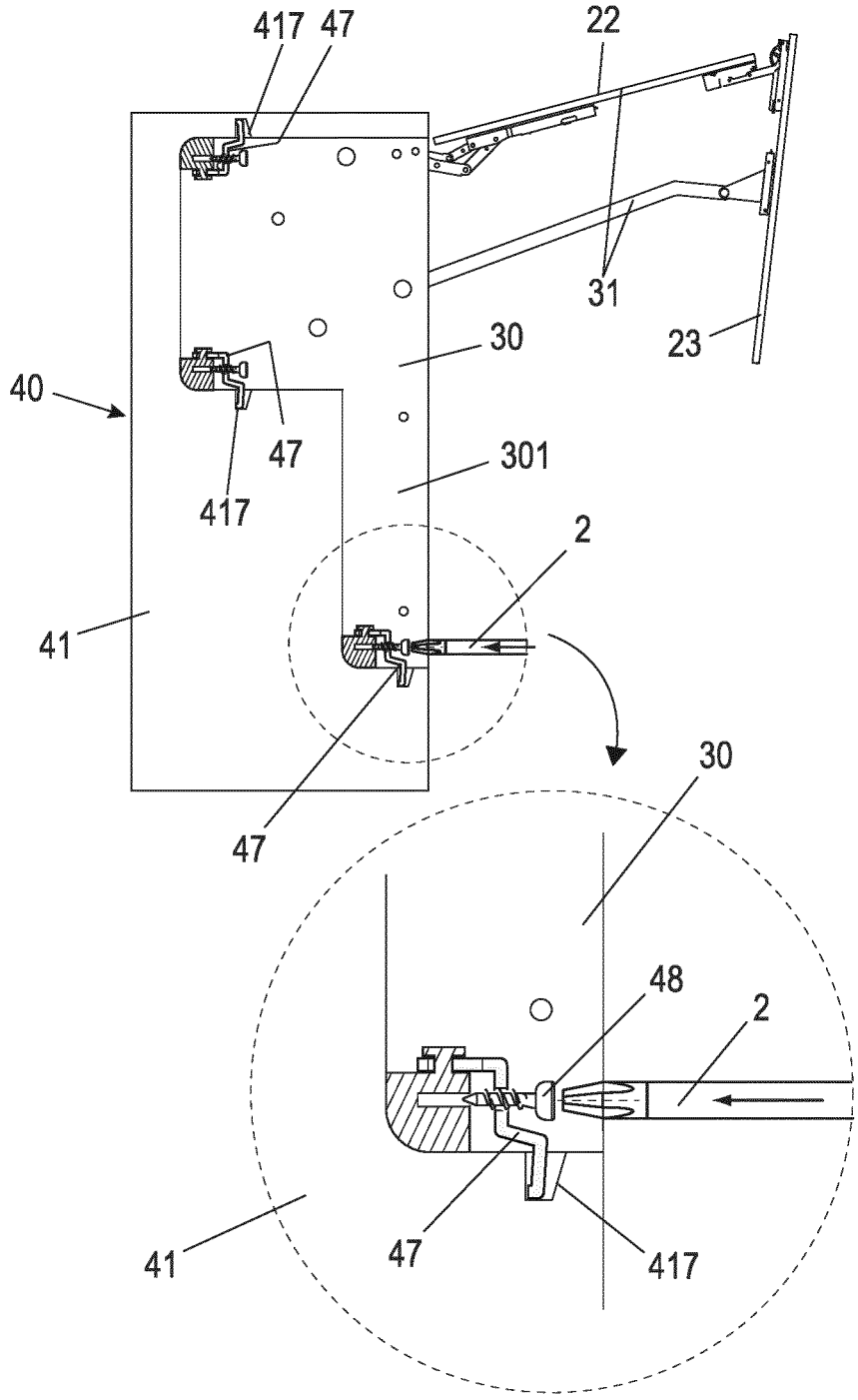
FIGS. 9, 10 show in each case one further embodiment example of a wall designed as a composite element in accordance with the application in a schematic side view.

FIGS. 7-9 show various other types of attachment of fitting 30 to the core 41 of the composite element 40.

FIG. 7 first shows in an isometric view on the left side a composite element 40 as the side wall of a furniture body. The furniture body also shows sections of a bottom panel and top panel. The outer surface layer is removed to show the installation position of the fitting 30 within the composite element 40. In the right area of the figure a schematic section is shown in the area of the edge of the inserted fitting 30, similar to FIG. 5*b*.

A web 304 is arranged in sections or circumferentially around the edge of the fitting 30 between the side plates 301. Before inserting the fitting 30, an adhesive bead 46 is inserted between the web 304 and the end faces 414*a*, 414*b* of the core 41. This can be done on one side, e.g., in the form of a hot-melt adhesive on one of the mentioned elements, e.g., as shown in FIG. 7 on the web 304. Alternatively, it is also conceivable that both elements, the web 304 and the end faces 414*a*, 414*b*, are coated with contact adhesive or multi-component adhesive, which binds without activation by increased temperature when the two elements are pressed together. In the left part of FIG. 7 the contact adhesive bead 46 is schematically drawn as a dashed line. If a recess 42*a*, 42*b* does not correspond to the thickness of the corresponding core half 41*a*, 41*b*, the side plate 301 of the fitting 30 is glued flat to the base of the recess 42*a*, 42*b* of the core half 41*a*, 41*b*.

FIG. 8 shows another type of connection between a fitting 30 and a core 41 of a composite element 40.

In contrast to the examples shown above, the end faces 414*a*, 414*b* extending along the edge of the recesses 42*a*, 42*b* are not exclusively formed by straight sections adjoining each other at an angle. Instead, there are undercut connecting elements 416*a*, 416*b* at several, three here by way of example, points along the end faces 414*a*, 414*b*, which have the shape of a cylinder in the present case. From the side plates 301 of the fitting 300, corresponding mating contours 305 to the connecting elements 416*a*, 416*b* are cut out. Instead of the shown cylindrical shape of the connecting elements 416*a*, 416*b* and the corresponding circular section shape of the mating contour 305, other undercut shapes, such as a trapezoidal shape or a simple shoulder, can also be used.

In a first assembly step I, the fitting 30 is placed on one of the basic elements, e.g., the core half 41*b* with the cover layer 43*b*, in such a way that the respective connecting elements 416*b* engage in the cutout mating contours 305 of the side plates 301 as in a puzzle. When assembling, adhesive can be applied to at least selected areas of the side plate 301 or the accessible part of the cover layer 43*b* in cutout 42*b* in order to connect the side plate 301 to the cover layer 43*b*. Finally, in a second assembly step II, the opposite basic element, here the core half 41*a* with the cover layer 43*a*, is glued or laminated onto the core half 41*b* or the facing side plate 301 of fitting 30.

If a recess 42*a*, 42*b* does not correspond to the thickness of the corresponding core half 41*a*, 41*b*, the side plate 301 of the fitting 30 can be glued flat to the bottom of the recess 42*a*, 42*b* of the core half 41*a*, 41*b*. In this case the cover layer 43*a*, 43*b* is only connected to the core half 41*a*, 41*b*.

The embodiment examples of composite elements 40 shown so far in FIGS. 5*a*, 5*b* and 6-8 are based on an inseparable, fixed embedding of fitting 30 in the composite element 40. FIG. 9 shows another embodiment example of a composite element 40 with fitting 30 inserted, in which fitting 30 is inserted from the end face 413*a* or 413*b* of the composite element 40 into the formed recess 42*a*, 42*b*. Also in this embodiment, the fitting 30 has two parallel side plates 301, on which the levers of the lever mechanism 31 are rotatably mounted and between which the lever mechanism 31 moves in when the flap is closed.

FIG. 9 shows the lever mechanism 31 and a two-part flap here with an upper flap part 22 and a lower flap part 23 in an extended state. In the gap formed between the two side plates 301, claws 47 are arranged, which can be turned outwards by means of a tool, for example the screwdriver 2 shown in connection with screws 48, and which can be clawed firmly in the area of the end face 414 of the core 41. In the area in which the claws 47 extend over the edge of the side plate 301, depressions 417 can be provided in the core 41, in which the claws engage, in a supporting manner. One of the areas of claws 47 is shown enlarged in the lower part of FIG. 9.

The advantage of the type of fastening of fitting 30 within the composite element 40 shown in FIG. 9 is that a defective fitting 30 can also be removed and replaced, which is not possible with the fixed fittings 30 in the embodiment examples of the composite element 40 shown above.

Alternatively, it is also possible that no fitting 30 or a receptacle housing is inserted during the manufacture of the composite element 40, but that fitting 30 is inserted into the recess 42 only after completion of the composite element 40 or the furniture body 10. The fastening can be carried out as shown in the description of FIG. 9.

In the embodiment examples shown, the recesses 42*a*, 42*b* are each formed in an approximately L-shaped manner, with a section projecting deeper into the core 41 being arranged in the upper area, in which hinge points for the lever mechanism 31 are also provided. The recess is formed less deep in the lower area. In this area, the fitting 30 only needs to be deep enough that, when the flap 20 is closed, the lever mechanism 31 can immerse in an orientation essentially parallel to the front edge 413*a* or 413*b*.

Figure 10:
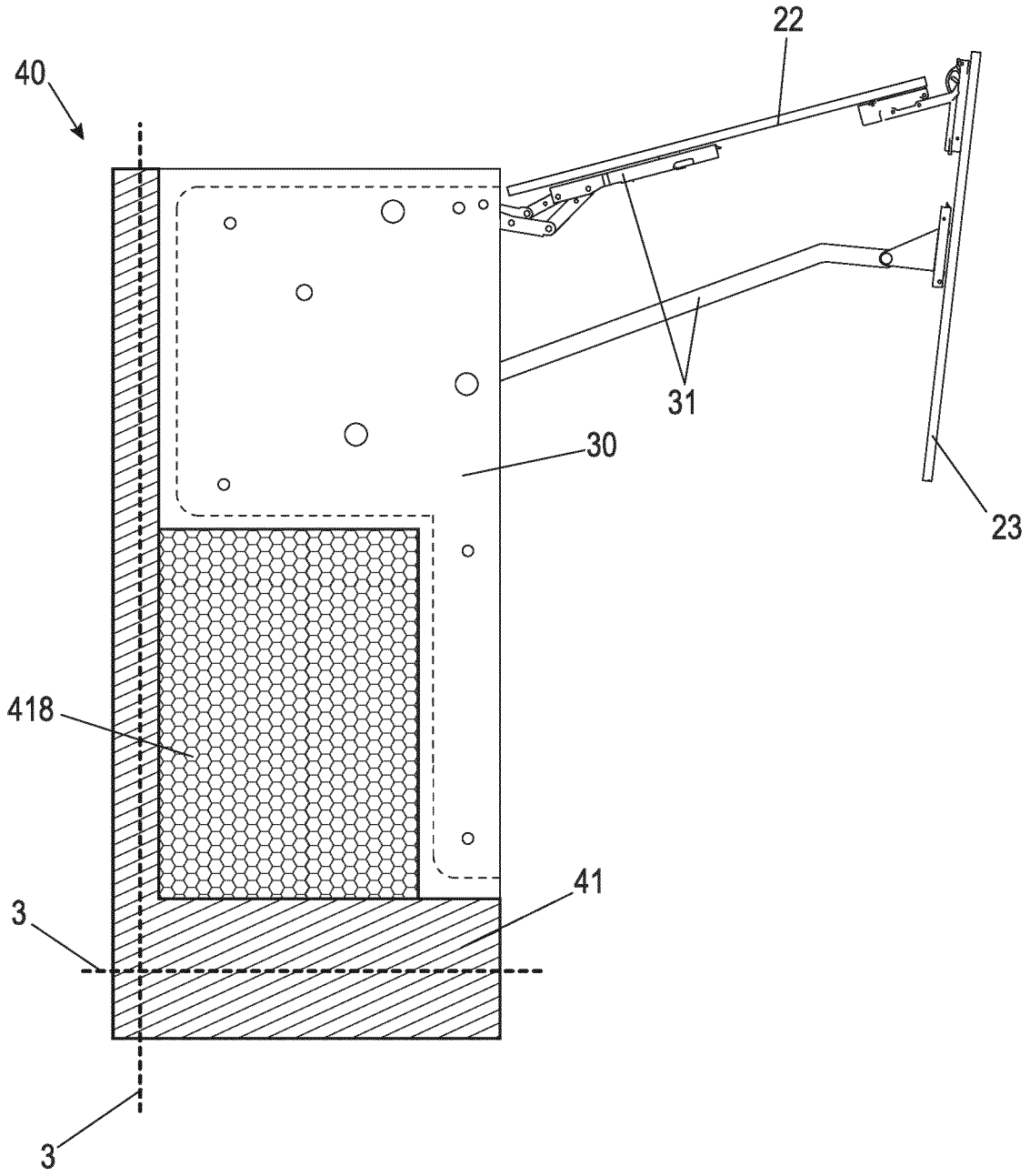

FIG. 10 shows an embodiment example of a composite element 40 in which the core 41 does not consist homogeneously of one material, but is designed as a composite material. In edge regions this core 41 is still made of two core halves 41*a*, 41*b* of a compacted material, for example a chipboard, an HDF or an MDF board. In an inner area, in particular in the lower part of core 41, where the fitting 30 is formed narrower, an insert 418 made of a light honeycomb structural material, for example a cardboard material, is provided. By using the honeycomb structure material, the weight of the composite element 40 and also the material costs can be reduced. In particular in connection with the applied and preferably glued-on cover layers 43*a*, 43*b*, sufficient stability of the composite element 40 is nevertheless achieved.

The composite element 40 shown in FIG. 10 is also designed for subsequent machining, in particular changing the length and width of the composite element 40. For example, dashed sectional lines 3 are provided, along which the composite element 40 can be cut to length as required after its manufacture, i.e., after the fitting 30 has been integrated into the core 41 and after the cover layers 43*a*, 43*b*, which are not shown here, have been applied. For example, a prefabricated composite element 40 with already integrated fitting 30 can also be used in joineries or smaller manufactories to produce tailor-made furniture.

Further fittings such as cabinet hangers or connecting elements for e.g., interior organization or connecting interfaces for furniture body 10 can be integrated into the composite element 40. Electrical cables and other electrical components can also be integrated in the composite element for electrification of the composite element 40. The integration of lighting equipment such as LED luminaires is also possible.

The embodiment examples relate to pieces of furniture in which the doors or flaps are guided by fittings which are largely integrated into vertically arranged side walls or partition walls of the furniture.

The core halves 41*a*, 41*b* can be provided for the production of a standard 16 mm wall in simple way by two 8 mm plates completely provided with cover layers, which can be already provided on both sides with a cover layer, wherein from one side the recesses 42*a*, 42*b* are inserted into the core halves 41*a*, 41*b*. The recesses 42*a*, 42*b* ideally have a bottom so that the opposite surface layers are not damaged. After the fitting 30 has been inserted into a recess, the core halves can be glued, wherein the core halves of this embodiment can also have a cover layer in the parting line.

Instead of the fitting 30 with the lever mechanism 31, which is already inserted into the composite element 40 during the manufacture of the composite element 40, a housing can also be used in which the actual fitting 30 with its lever mechanism 31 is inserted after the manufacture of the composite element 40 or the furniture body 10.

Figure 11:
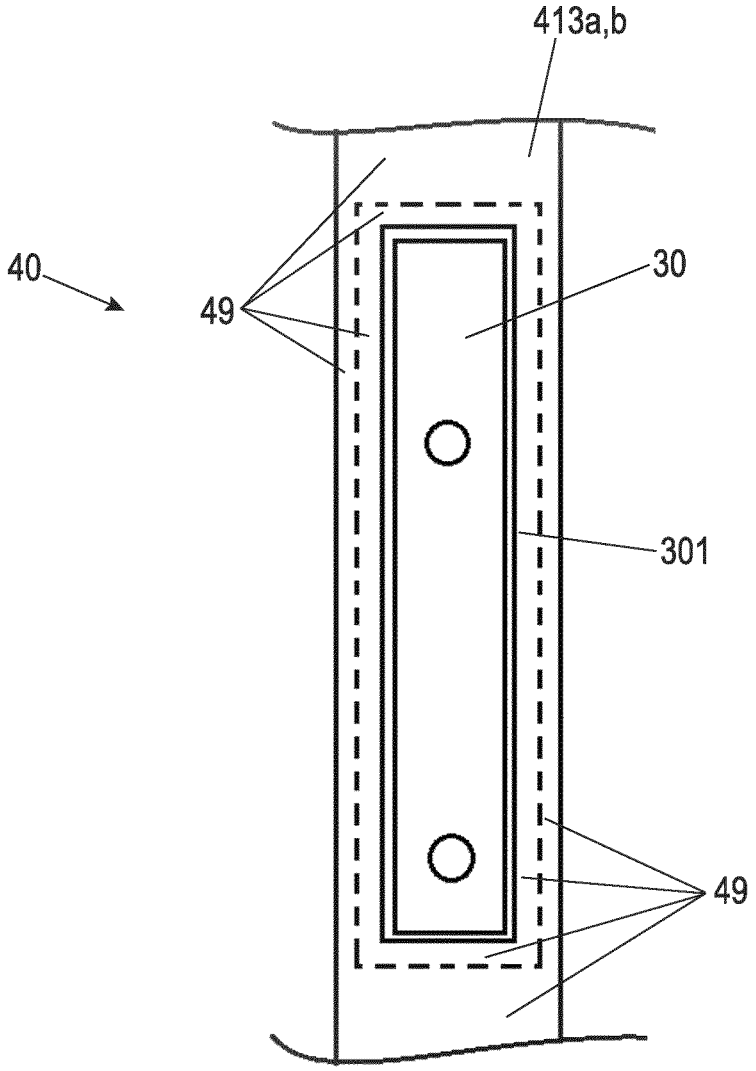
FIG. 11 shows a schematic top view of a front end face of a composite element in the area of an inserted fitting.

FIG. 11 shows in a plan view of the front end face 413 a section of a composite element 40 in the area of fitting 30. In this embodiment example an edge band 49 is applied as a narrow side coating to the front end faces 413*a, b* of the core halves 41*a, b* and thus of the composite element 40. Further edge bands not visible here may be applied in the area of the upper or lower end faces 412*a, b* or the rear end face 411*a, b*.

In the area of the opening of the fitting 30, from which, for example, the lever mechanism 31, which is not visible in this illustration, extends, the edge band 49 is recessed. The edge band 49 is applied to the front end faces 413*a, b* after integration of fitting 30 into composite element 40 or also after insertion of fitting 30 into composite element 40.

The edge band 49 is cut out so that it rests on the fitting in sections and covers, for example, the edges of the side plates 301 of fitting 30 or other elements visible outside the opening of fitting 30. In FIG. 11 the contours of fitting 30 are dashed. Due to the arrangement of the edge band 49 also on sections of the fitting 30, the fitting 30—with the exception of the extendable lever mechanism 31—is completely integrated into the composite element 40 and no longer visible at the front end of the composite element 40.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Milling tool
2 Screwdriver
3 Intersection line
10 Furniture body
11 Bottom panel
12 Top panel
13 Side wall
131 Side surface
132 End face
133 Opening in end face
14 Partition wall
20 Flap arrangement
21 Integral flap
22 Upper flap part
23 Lower flap part
24 Handle
25 Hinge
30 Fitting
301 Side plate
302 Lug
303 Projecting staple
304 Web
305 Mating contour
31 Lever mechanism
40 Composite element
41 Core
41*a, b* Core half
411*a, b* Rear end face
412*a, b* Upper or lower end face
413*a, b* Front remaining end face
414*a, b* End face of the recess
415*a, b* Shoulder surface
416*a, b* Connecting elements
417 Depression
418 Insert
42*a, b* Recess
43*a, b* Cover layer
44 Hinge
45 Pin
46 Adhesive bead
47 Claw
48 Screw
49 Edge band
I, II Assembly step

The invention claimed is:

1. A wall for a furniture body with integrated fitting, the wall comprising:

a panel-shaped core arranged between two laterally positioned cover layers, wherein the panel-shaped core has a recess extending at least along a section of an end face of the wall and is configured to receive an integrated fitting that guides a movable furniture part, the panel-shaped core has two core halves located one upon the other by way of side surfaces located opposite the respective cover layer and have recesses supplementing one another to form the recess, the fitting comprises a lever mechanism, with the lever mechanism guiding the movable furniture part, and the lever mechanism is located between the two laterally positioned cover layers in a closed state of the movable furniture part.

2. The wall of claim 1, wherein the side surfaces of the two core halves are aligned parallel to the two laterally positioned cover layers.

3. The wall of claim 1, wherein at least one of the recesses of the two core halves penetrates the associated core half at least partially up to the respective one of the two laterally positioned cover layers.

4. The wall of claim 1, wherein the recess of the panel-shaped core is narrower than a distance between the two laterally positioned cover layers.

5. The wall of claim 1, wherein the fitting is connected to the two core halves or at least one of the two laterally positioned cover layers.

6. The wall of claim 1, wherein at least one of the two core halves has a reduced thickness along an edge of the respective recess in such a way that a shoulder surface is formed towards the recess of the core half, on which shoulder surface the fitting rests with at least one lug projecting beyond its edge.

7. The wall of claim 6, wherein at least one staple, which is pressed into material of at least one core half in a region of the shoulder surface, projects out of the at least one lug.

8. The wall of claim 1, wherein the fitting is bonded to the two core halves or at least one of the two laterally positioned cover layers.

9. The wall of claim 1, wherein connecting elements are formed from the two core halves adjacent to the recesses of the two core halves and engage in the fitting.

10. The wall of claim 9, wherein the fitting has side plates with recesses forming mating contours in which the connecting elements engage.

11. The wall of claim 1, wherein the fitting comprises two side plates having a maximum spacing that is smaller than a thickness of the panel-shaped core.

12. The wall of claim 1, having a thickness between 15 mm and 20 mm.

13. The wall of claim 1, wherein at least one edge band is applied to at least one end face of the panel-shaped core.

14. The wall of claim 13, wherein the edge band is arranged at least in sections on the fitting.

15. A method for manufacturing a wall with an integrated fitting for a furniture body, the method comprising:

providing two panel-shaped core halves;

introducing a recess into each of the two panel-shaped core halves, the recess extending at least along a section of an end face of the respective panel-shaped core half;

applying a respective lateral cover layer to the two panel-shaped core halves before or after the introduction of the recess; and joining the two panel-shaped core halves together to form a panel-shaped core, with side surfaces of the two panel-shaped core halves opposite the respective cover layer lie one upon the other;

wherein the fitting is inserted into the recesses before the two panel-shaped core halves are joined together.

16. The method of claim 15, wherein the recesses of the two panel-shaped core halves are milled out of the core halves.

17. The method of claim 16, wherein the recesses of the two panel-shaped core halves are milled out with a milling tool from the side surface of the two panel-shaped core halves.

18. The method of claim 15, wherein the two panel-shaped core halves are bonded together.

19. The method of claim 18, wherein the fitting engages in the two panel-shaped core halves with staples or claws for its fastening.

20. A piece of furniture or furniture body, comprising:

a wall with an integrated fitting, the wall comprising a panel-shaped core arranged between two laterally positioned cover layers, wherein the panel-shaped core has a recess extending at least along a section of an end face of the wall and is configured to receive an integrated fitting that guides a movable furniture part, the panel-shaped core has two core halves located one upon the other by way of side surfaces located opposite the respective cover layer and have recesses supplementing one another to form the recess, the fitting comprises a lever mechanism, with the lever mechanism guiding the movable furniture part, and the lever mechanism is located between the two laterally positioned cover layers in a closed state of the movable furniture part.

21. The piece of furniture or furniture body of claim 20, wherein the wall is a side wall or a partition wall.

22. The piece of furniture or furniture body of claim 20, wherein the fitting is a flap fitting or a door fitting.

* * * * *